US007062209B2

(12) United States Patent
Murakami et al.

(10) Patent No.: US 7,062,209 B2
(45) Date of Patent: Jun. 13, 2006

(54) TRANSFER DEVICE WITH COAXIAL ROTATING CAMS

(75) Inventors: Susumu Murakami, Soraku-gun (JP); Yoshie Iwakura, Higashiosaka (JP); Takahiro Fukunaga, Sakurai (JP); Masanori Yamada, Nara (JP); Kuniaki Nakano, Soraku-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 11/035,395

(22) Filed: Jan. 12, 2005

(65) Prior Publication Data

US 2005/0158085 A1 Jul. 21, 2005

(30) Foreign Application Priority Data

Jan. 16, 2004 (JP) ..... 2004-009111

(51) Int. Cl.
*G03G 15/01* (2006.01)

(52) U.S. Cl. ..... 399/299

(58) Field of Classification Search ..... 399/299, 399/302

See application file for complete search history.

(56) References Cited

U.S. PATENT DOCUMENTS 4,870,456 A * 9/1989 Watanabe et al. ..... 399/92
2003/0223785 A1* 12/2003 Kanekura et al. ..... 399/299

FOREIGN PATENT DOCUMENTS

JP 10-039651 2/1998
JP 2001-166602 6/2001

* cited by examiner

*Primary Examiner*—Quana Grainger
(74) *Attorney, Agent, or Firm*—George W. Neuner; David G. Conlin; Edwards Angell Palmer & Dodge LLP

(57) ABSTRACT

A transfer device has primary transfer rollers supported so as to be upwardly and downwardly movable within a path of movement and opposed to respective of photosensitive drums across a portion of an intermediate transfer belt. There are also provided a slide member for full-color image formation and a slide member for monochromatic image formation, which are capable of reciprocation in a horizontal direction. The transfer device includes roller lifting means each L-shaped and each having one end supporting an associated one of the transfer rollers for rotation and another end engaging an associated one of the slide members, and first and second coaxial rotating cams. The transfer device is capable of switching between three paths of movement of the intermediate transfer belt selectively by the first and second rotating cams rotating together.

7 Claims, 8 Drawing Sheets

TRANSFER DEVICE WITH COAXIAL ROTATING CAMS

CROSS REFERENCE

This Nonprovisional application claims priority under 35 U.S.C. § 119(a) on Patent Application No. 2004-009111 filed in Japan on Jan. 16, 2004, the entire contents of which are hereby incorporated by reference.

BACKGROUND OF THE INVENTION

The present invention relates to a transfer device for use in image forming apparatus which is operative to transfer a toner image formed by electrophotographic image formation to a recording medium such as a recording sheet (hereinafter will be referred to as "recording sheet") via an endless belt. More particularly, the invention relates to such a transfer device operative to transfer a toner image from an image carrier to the endless belt or a recording sheet on the endless belt by the use of a transfer roller.

DESCRIPTION OF THE RELATED ART

In recent years, there is an increasing demand that electrophotographic image forming apparatus be capable of not only monochromatic image formation but also full-color image formation. To meet such a demand, the development of an electrophotographic full-color image forming apparatus is being pursued. Usually, such a full-color image forming apparatus performs image formation using color toners corresponding to respective color image data items obtained by color separation of a full-color image. For example, such an image formation process includes: reading the same color image through filters for three additive primary colors (red, green and blue); obtaining color image data items respectively corresponding to three subtractive primary colors (cyan, magenta and yellow) and black from the data thus read; forming visualized images based on the respective color image data items using color toners corresponding to the respective color image data items; and superimposing the visualized images of the respective colors one upon another to form a full-color image.

Such a full-color image forming apparatus is required to perform a series of steps, i.e., exposure, development and transfer, for each color as well as to superimpose visualized images of respective colors one upon another with difficult registration. For this reason, the full-color image forming apparatus gives a strong impression that its full-color image forming rate is lower than its monochromatic image forming rate.

In attempt to overcome this inconvenience, a tandem type full-color image forming apparatus has heretofore been proposed which includes a revolvable semiconducting endless belt and a row of image forming sections arranged in the direction of movement of the outer peripheral surface of the endless belt, the image forming sections being configured to individually form visualized images colored different from each other, and which forms one full-color image during at least one revolution of the endless belt, as disclosed in Japanese Patent Application Laid-Open No. H10-039651.

Such tandem type full-color image forming apparatus include an apparatus employing the intermediate transfer system which is configured to form full-color images by superimposing visualized images of respective colors one upon another on the outer peripheral surface of an endless belt (intermediate transfer belt) and then transferring the resulting image-to a-recording sheet, the visualized images being formed on the surfaces of respective photosensitive drums as the image carriers at respective image forming sections.

Such a tandem type full-color image forming apparatus employing the intermediate transfer system is capable of full-color image formation and monochromatic image formation both. In the full-color image formation, as shown in FIG. 1A, the transfer device included in the apparatus body performs a primary transfer process in which: up-and-down transfer rollers 13A to 13D held by respective transmission members 215A to 215D within a looped path of movement defined by an endless belt 11 are moved down to bring the outer periphery of the endless belt 11 into contact with the periphery of a respective one of image carriers (photosensitive drums) 101A to 101D corresponding to respective colors; and visualized images formed on respective of the image carriers based on color image information items corresponding to respective colors obtained by color separation are transferred to the endless belt 11 by electric power supplied to the transfer rollers 13A to 13D, and a secondary transfer process in which the image resulting from the primary transfer process is transferred to a recording sheet.

In the monochromatic image formation, as shown in FIG. 1B, the transfer device performs a primary transfer process in which: only the transfer roller 13A, which is opposed to the photosensitive drum 101A adapted to form a visualized black image, is moved down to bring the outer periphery of the endless belt 11 into contact with the periphery of the photosensitive drum 101A only; and a visualized black image formed based on image information is transferred to the endless belt 11 by electric power supplied to the transfer roller 13A only, and a secondary transfer process in which the image is transferred to a recording sheet.

In the standby state where no image formation is performed, as shown in FIG. 1C, all the transfer rollers 13A to 13D are kept raised, so that the outer periphery of the endless belt 11 is kept apart-from the peripheries of the photosensitive drums 101A to 101D.

The transfer roller 13A moves up as the periphery of a second eccentric cam 212 included in a pair of first and second coaxial eccentric cams 211 and 212 for monochromatic image formation displaces with rotation, while the transfer rollers 13B to 13D moves up as the periphery of a second eccentric cam 222 included in a pair of first and second coaxial eccentric cams 221 and 222 for full-color image formation displaces with rotation. The pair of the first and second eccentric cams 211 and 212 and the pair of the first and second eccentric cams 221 and 222 are connected to respective of motors for monochromatic image formation and for full-color image formation and are rotated by the respective motors.

As the periphery of the second eccentric cam 212 displaces, a cam follower 214 abutting thereon reciprocates horizontally. The same holds true for a cam follower 224 associated with the second eccentric cam 222. With reciprocation of the cam follower 214, the transfer roller 13A moves up together with the transmission member 215A. Similarly, with reciprocation of the cam follower 224, the transfer rollers 13B to 13D move up together with the transmission members 215B to 215D.

However, since the arrangement shown in FIG. 1 requires such components as individual motors for respective of monochromatic image formation and full-color image formation, the pair of first and second eccentric cams 211 and 221 and the pair of first and second eccentric cams 221 and 222, the transfer device has a complicated structure and incurs increased cost.

A feature of the present invention is to provide a transfer device which has a simplified structure and is capable of switching between paths of movement of the endless belt for respective of a monochromatic image formation mode, a full-color image formation mode, and a standby state in which no image formation is performed.

SUMMARY OF THE INVENTION

According to the present invention, there is provided a transfer device including:

plural transfer rollers supported so as to be upwardly and downwardly movable within a looped path of movement defined by an endless belt and opposed to respective of plural image carriers across a portion of the endless belt, the plural image carriers including plural image carriers for full-color image formation and an image carrier for monochromatic image formation, which are arranged in a row from an upstream side to a downstream side in a fixed direction of movement of the endless belt;

a first path along which the endless belt is in contact with all the plural image carriers, and a second path along which the endless belt is in contact with only the image carrier for monochromatic image formation;

a third path along which the endless belt is spaced apart from all the plural image carriers;

a transfer member moving mechanism for full-color image formation operative to reciprocate in a direction substantially parallel with the fixed direction of movement to raise and lower the transfer rollers opposed to respective of the image carriers for full-color image formation, and a transfer member moving mechanism for monochromatic image formation operative to reciprocate in the direction substantially parallel with the fixed direction of movement to raise and lower the transfer roller opposed to the image carrier for monochromatic image formation; and first and second coaxial rotating cams having respective predetermined peripheral shapes, the first and second rotating cams being operative to cause respective of the transfer member moving mechanism for full-color image formation and the transfer member moving mechanism for monochromatic image formation to reciprocate as peripheries of respective of the first and second rotating cams displace with rotation, thereby switching the path of movement from one of the first to third paths to another selectively.

The foregoing and other features and attendant advantages of the present invention will become more apparent from the reading of the following detailed description of the invention in conjunction with the accompanying drawings.

DETAILED DESCRIPTION OF THE INVENTION

The present invention will now be described in detail with reference to the accompanying drawings.

Figure 1A:
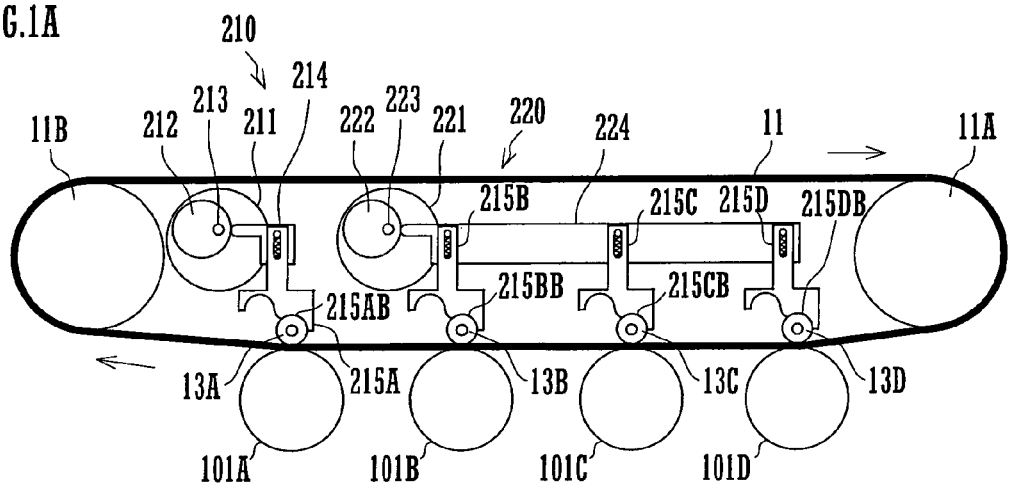
PRIOR ART FIG.1A
FIGS. 1A to 1C are schematic views each illustrating a path of movement of an endless belt used in a conventional transfer device.
Figure 1B:
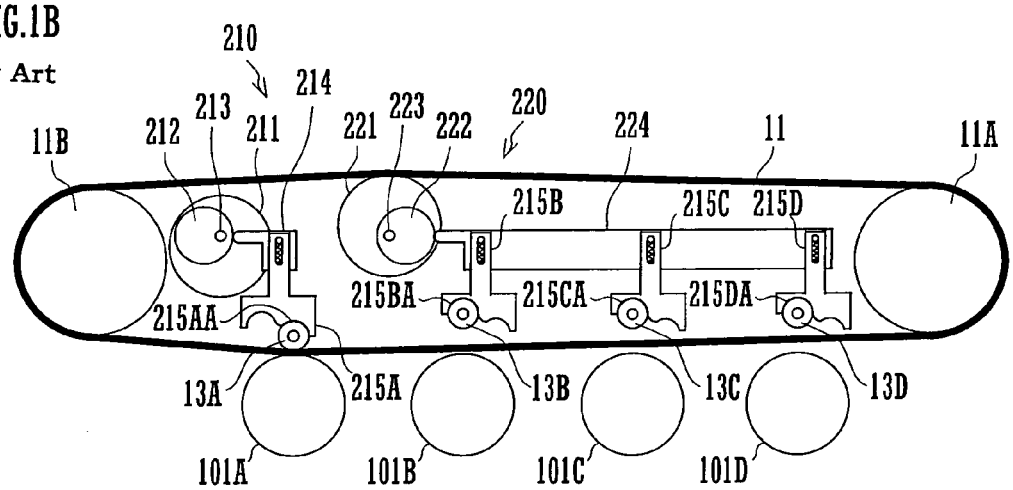
FIG.1B Prior Art
Figure 1C:
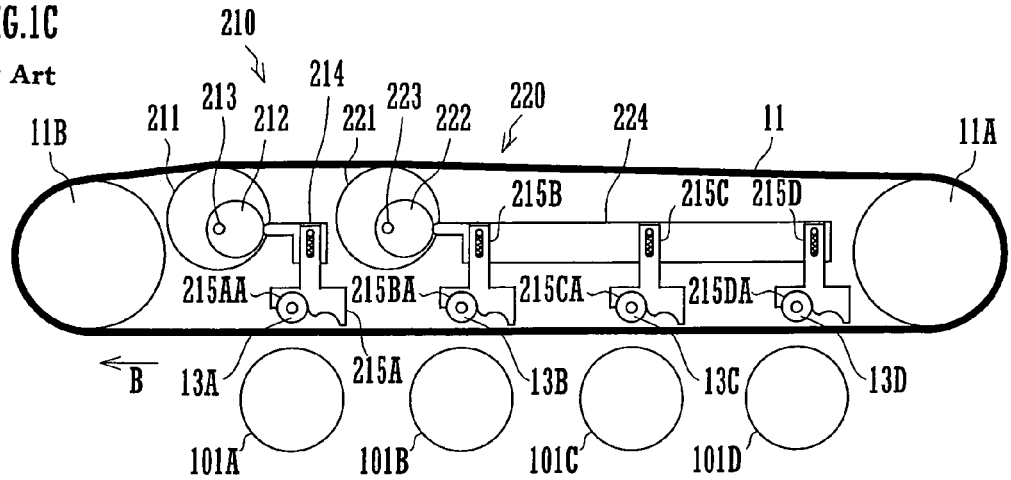
FIG.1C Prior Art
Figure 2:
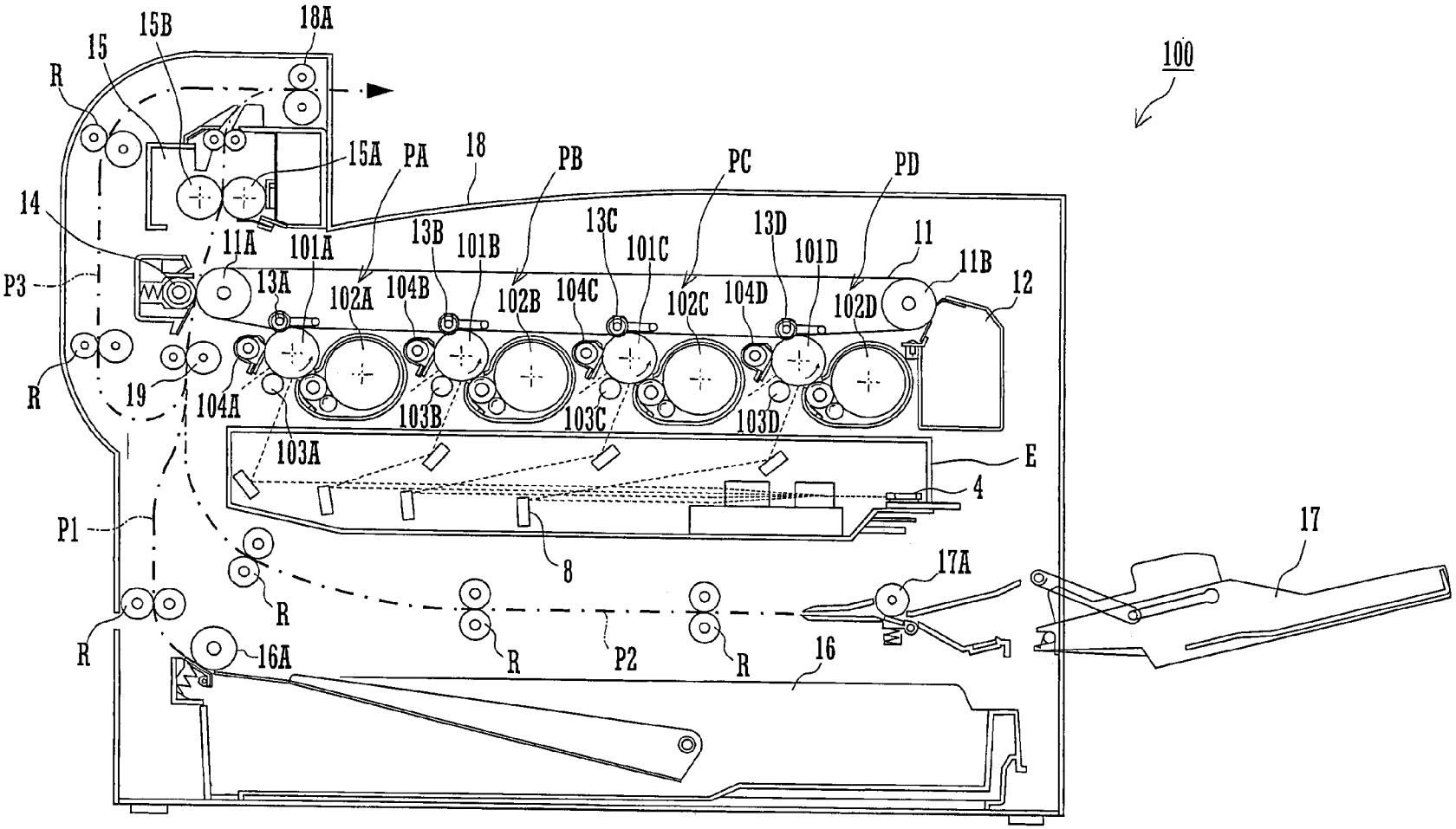
FIG. 2 is a schematic view showing the construction of an image forming apparatus including a transfer device embodying the present invention.

FIG. 2 is a schematic view showing the construction of an image forming apparatus 100 including a transfer device embodying the present invention. The image forming apparatus 100 is capable of forming both a multiple color image and a monochromatic color image on a recording medium, such as a recording sheet, according to image data transmitted from outside. The image forming apparatus 100 includes exposure unit E, photosensitive drums (corresponding to the image carriers defined by the present invention) 101A to 101D, developing units 102A to 102D, charger rollers 103A to 103D, cleaning units 104A to 104D, intermediate transfer belt (corresponding to the endless belt defined by the present invention) 11, primary transfer rollers (corresponding to the transfer rollers defined by the present invention) 13A to 13D, secondary transfer roller 14, fixing device 15, sheet feed paths P1, P2 and P3, sheet feed cassette 16, manual feed tray 17, ejected sheet tray 18, and the like.

The intermediate transfer belt 11 and the primary transfer rollers 13A to 13D are included in the transfer device of the present invention.

The image forming apparatus 100 performs image formation using image data items corresponding to four colors including black (K) in addition to the three subtractive primary colors, i.e., yellow (Y), magenta (M) and cyan (C), which are obtained by color separation of a full-color image. Four photosensitive drums 101A to 101D, four developing units 102A to 102D, four charger rollers 103A to 103D, four primary transfer rollers 13A to 13D and four cleaning units 104A to 104D are provided corresponding to the four colors to form four image forming sections PA to PD. The image forming sections PA to PD are arranged in a row along the direction of movement of the intermediate transfer belt 11 (secondary scanning direction).

Each of the charger rollers 103A to 103D is a contact type charger adapted to electrostatically charge the surface of the associated one of the photosensitive drums 101A to 101D to a predetermined potential uniformly. Instead of the charger rollers 103A to 103D, it is possible to use contact type chargers each employing a charger brush or non-contact type charger devices each employing a static charger. The exposure unit E, which includes a non-illustrated semiconductor laser, a polygonal mirror 4, a reflecting mirror 8, and the like, irradiates the photosensitive drums 101A to 101D with respective laser beams modulated according to image data items corresponding to respective of the colors, i.e., black, cyan, magenta and yellow. Thus, the photosensitive drums 101A to 101D become formed with respective latent images based on the image data items corresponding to respective of black, cyan, magenta and yellow.

Each of the developing units 102A to 102D supplies a developer to the surface of the associated one of the photosensitive drums 101A to 101D formed with a respective one of the latent images to turn the latent image into a visible toner image. The developing units 102A to 102D have stored therein a black developer, a cyan developer, a magenta developer and a yellow developer, respectively, for developing the latent images formed on the respective photosensitive drums 101A to 101D into a black toner image, a cyan toner image, a magenta toner image and a yellow toner image, respectively. Each of the cleaning units 104A to 104D removes and collects residual toner which remains on the surface of the associated one of the photosensitive drums 101A to 101D after the development and transfer process has been completed.

The intermediate transfer belt 11 extending above the photosensitive drums 101A to 101D is entrained about a driving roller 11A and a driven roller 11B to form a looped path of movement. The intermediate transfer belt 11 has an outer peripheral surface coming to face the photosensitive drums in the order of 101D, 101C, 101B and 101A. The primary transfer rollers 13A to 13D are opposed to the photosensitive drums 101A to 101D, respectively, across the intermediate transfer belt 11. The positions at which the intermediate transfer belt 11 faces the photosensitive drums 101A to 101D are primary transfer positions, respectively.

The intermediate transfer belt 11 comprises an endless film having a thickness of about 100 to about 150 μm and has a volume resistivity on the order of $10^{11}$ to $10^{12}$ Ω·cm. If the volume resistivity of the intermediate transfer belt 11 is lower than this order, leakage current occurs from the intermediate transfer belt 11 and, hence, transfer electric power sufficient for primary transfer cannot be maintained. On the other hand, if the volume resistivity of the intermediate transfer belt 11 is higher than this order, additional means will be needed to eliminate static charge on the intermediate transfer belt 11 at a location past each transfer position.

The primary transfer rollers 13A to 13D are applied with primary transfer bias (corresponding to the transfer electric power defined by the present invention) of a polarity opposite to the polarity of electrostatically charged toner under constant voltage control in order to transfer toner images carried on the respective photosensitive drums 101A to 101D to the intermediate transfer belt 11. Thus, the toner images of the respective colors formed on the respective photosensitive drums 101A to 101D are sequentially transferred to the outer peripheral surface of the intermediate transfer belt 11 so as to be superimposed one upon another, thereby forming a full-color toner image on the outer peripheral surface of the intermediate transfer belt 11.

If image data items corresponding to only some of the colors, i.e., yellow, magenta, cyan and black, are inputted, only those of the four photosensitive drums 101A to 101D which correspond to the colors corresponding to the inputted image data items are formed with respective latent images and then toner images. In monochromatic image formation for example, only the photosensitive drum 101A corresponding to black is formed with a latent image and then a black toner image, followed by transfer of only the black toner image to the outer peripheral surface of the intermediate transfer belt 11.

In this embodiment, in order to make constant the amount of primary transfer bias to be applied to the intermediate transfer belt 11, all the primary transfer rollers 13A to 13D are constantly applied with primary transfer bias during both of monochromatic image formation and full-color image formation. Accordingly, all the primary transfer rollers 13A to 13D are constantly in contact with the intermediate transfer belt 11. If not, the amount of primary transfer bias to be applied to the intermediate transfer belt 11 varies, which results in variations in transfer precision.

The primary transfer rollers 13A to 13D each comprise a metal shaft (of stainless steel for example) having a diameter of 8 to 10 mm and an electrically conductive resilient member (of EPDM or foamed urethane for example) covering the surface of the shaft. The intermediate transfer belt 11 can be uniformly applied with a high voltage through the electrically conductive resilient member.

In addition, the primary transfer rollers 13A to 13D are biased toward the photosensitive drums 101A to 101D, respectively, in a direction other than respective normal directions of the photosensitive drums 101A to 101D.

The toner image thus formed on the outer peripheral surface of the intermediate transfer belt 11 at each transfer position is transported by revolution of the intermediate transfer belt 11 to a position opposite to the secondary transfer roller 14. During image formation the secondary transfer roller 14 is pressed at a predetermined nip pressure against the outer peripheral surface of the intermediate transfer belt 11 at a location where the inner peripheral surface of the intermediate transfer roller 11 is in contact with the driving roller 11A. The secondary transfer roller 14 is applied with a high voltage of a polarity opposite to the polarity of charged toner during passage of a recording sheet fed from the sheet feed cassette 16 or the manual feed tray 17 between the secondary transfer roller 14 and the intermediate transfer belt 11. This operation causes the toner image to be transferred from the outer peripheral surface of the intermediate transfer belt 11 to a surface of the recording sheet.

For the nip pressure between the secondary transfer roller 14 and the intermediate transfer belt 11 to be kept at the predetermined value, one of the secondary transfer roller 14 and the driving roller 11A is formed of a hard material (such as a metal), while the other formed of a soft material such as a resilient roller (for example resilient rubber roller or foamed resin roller).

Of the toner attached to the intermediate transfer belt 11 from the photosensitive drums 101A to 101D, residual toner fractions that remain on the intermediate transfer belt 11 without having been transferred to the recording sheet are collected by the cleaning units 104A to 104D to avoid color mixture in the succeeding process.

The recording sheet bearing the toner image transferred thereto is guided to the fixing device 15 where the recording sheet is subjected to heat and pressure during its passage between a heating roller 15A and a pressure roller 15B. This operation allows the toner image to be firmly fixed to the surface of the recording sheet. The recording sheet bearing the toner image thus fixed thereto is ejected by ejection rollers 18A onto the ejected sheet tray 18.

The image forming apparatus 100 defines substantially vertical sheet feed path P1 for transporting recording sheets held in the sheet feed cassette 16 to the ejected sheet tray 18 by passing them between the secondary transfer roller 14 and the intermediate transfer belt 11 and through the fixing device 15. The sheet feed path P1 is provided with a pickup roller 16A operative to pay out the recording sheets held in the sheet feed cassette 16 onto the sheet feed path P1 one by one, transport rollers R operative to transport each of the paid-out recording sheets upwardly, register rollers 19 operative to guide each transported recording sheet to between the secondary transfer roller 14 and the intermediate transfer belt 11 with predetermined timing, and the ejection rollers 18A operative to eject each recording sheet onto the ejected sheet tray 18.

Also, the image forming apparatus 100 internally defines sheet feed path P2 which extends from the manual feed tray 17 to the register rollers 19 and which is provided with a pickup roller 17A and transport rollers R. Further, the image forming apparatus 100 defines sheet feed path P3 extending from the ejection rollers 18A to the upstream side of the register rollers 19 in the sheet feed path P1.

The ejection rollers 18A are forwardly and backwardly rotatable. The ejection rollers 18A are rotated forwardly to eject a recording sheet onto the ejected sheet tray 18 in a one-sided image formation mode in which an image is formed on one side of a recording sheet and during a second side image forming operation in a double-sided image formation mode in which images are formed on the both sides of a recording sheet.

During a first side image forming operation in the double-sided image formation mode, on the other hand, the ejection rollers 18A are rotated forwardly until the trailing edge of a recording sheet has passed through the fixing device 15 and then driven backwardly with the trailing edge of the recording sheet caught therebetween to guide the recording sheet onto the sheet feed path P3. This operation causes the recording sheet bearing an image on one side thereof to be turned upside down and front side back and guided to the sheet feed path P1.

The register rollers 19 guide a recording sheet fed thereto from the sheet feed cassette 16 or the manual feed tray 17 or through the sheet feed path P3 to between the secondary transfer roller 14 and the intermediate transfer belt 11 in synchronization with revolution of the intermediate transfer belt 11.

For this purpose, the register rollers 19 stop rotating in the beginning of the operation of the photosensitive drums 101A to 101D and the intermediate transfer belt 11 and, therefore, a recording sheet fed or transported prior to the revolution of the intermediate transfer belt 11 stops traveling on the sheet feed path P1 with its front or leading edge abutting against the register rollers 19. Thereafter, the register rollers 19 start rotating with such timing as to register the leading edge of the recording sheet with the leading edge of a toner image on the intermediate transfer belt 11 at the location where the secondary transfer roller 14 presses against the intermediate transfer belt 11.

Figure 3:
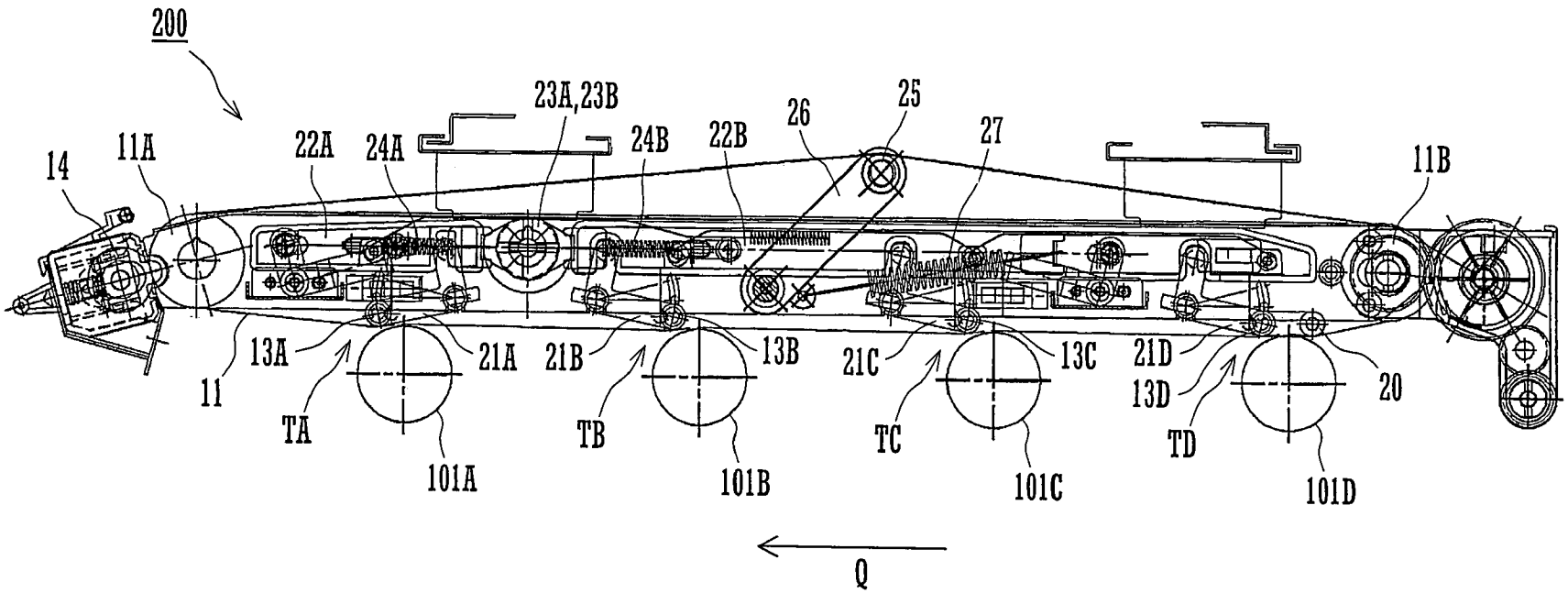
FIG. 3 is a front elevational view showing the construction of the transfer device.

FIG. 3 is a front elevational view showing the construction of a transfer device embodying the present invention. In the transfer device 200 according to this embodiment, the primary transfer positions TA to TD are opposed to the lower side of the looped path of movement of the intermediate transfer belt 11 entrained about the driving roller 11A and the driven roller 11B. The secondary transfer roller 14 is located downstream of and adjacent the primary transfer roller 13A located most downstream in the direction of movement of the intermediate transfer belt 11 indicated by arrow Q.

The purpose of this arrangement is to simplify the secondary transfer structure for transferring a toner image from the intermediate transfer belt 11 to a recording sheet fed substantially vertically thereby realizing a reduction in the size of the image forming apparatus 100, as well as to shorten the time period from the beginning of the primary transfer by the primary transfer roller 13D located most upstream until the completion of the secondary transfer by the secondary transfer roller 14 thereby increasing the image forming rate.

At the primary transfer positions TA to TD the primary transfer rollers 13A to 13D are each located slightly downstream of the associated one of the photosensitive drums 101A to 101D in the direction of movement of the intermediate transfer belt 11 and positioned so as not to contact the associated one of the photosensitive drums 101A to 101D across the intermediate transfer belt 11. The intermediate transfer belt 11 is constantly pressed in such a direction as to contact the photosensitive drums 101A to 101D by the primary transfer rollers 13A to 13D.

Each of the primary transfer rollers 13A to 13D is rotatably supported at one end of the associated one of L-shaped roller lifting members 21A to 21D. Each of the roller lifting members 21A to 21D is L-shaped in a section perpendicular to the axis of the associated one of the primary transfer rollers 13A to 13D and is pivotally supported at its bent portion by a shaft extending parallel with the axis of the associated transfer roller. The roller lifting member 13A is in engagement with a slide member 22A at its upper (other) end, while the roller lifting members 13B to 13D are in engagement with a slide member 22B at their upper (other) ends.

The slide members 22A and 22B engage first and second coaxial rotating cams 23A and 23B, respectively, and are capable of horizontally reciprocating by displacement of the peripheries of the respective rotating cams 23A and 23B which occurs with rotation of the cams 23A and 23B and the elastic forces of respective springs 24A and 24B working in a horizontal direction substantially parallel with the direction Q. As the slide members 22A and 22B slide horizontally, the roller lifting members 21A to 21D pivot, thus causing the primary transfer roller 13A to move toward and away from the photosensitive drum 101A singly while causing the primary transfer rollers 13B to 13D to move toward and away from respective of the photosensitive drums 101B to 101D together.

In the full-color image formation, the primary transfer takes place at all the primary transfer positions TA to TD and, accordingly, all the primary transfer rollers 13A to 13D are kept lowered to their respective low positions close to the respective photosensitive drums 101A to 101D. In the monochromatic image formation, the primary transfer takes place at only the primary transfer position TA and, accordingly, only the primary transfer roller 13A is kept lowered to its low position close to the photosensitive drum 101A. In the standby state where no image formation is performed, all the primary transfer rollers 13A to 13D are kept raised to their respective high positions spaced apart from the respective photosensitive drums 101A to 101D.

In this embodiment, each of the roller lifting members 21A to 21D has such dimensions that the distance from the bent portion to the portion rotatably supporting the associated one of the primary transfer rollers 13A to 13D is longer than the distance from the bent portion to the upper end engaging the associated one of the slide members 22A and 22B. Accordingly, the up-and-down distance each primary transfer roller is raised and lowered is longer than the distance each slide member slides.

With this arrangement, even when the range within which each of the slide members 22A and 22*b* can reciprocate is relatively small, each of the primary transfer rollers 13A to 13D can move up and down within a relatively large range. For this reason, each primary transfer roller can be easily raised to a position from which the primary transfer bias fails to influence the associated photosensitive drum in a state not formed with a toner image (a position spaced 3 to 5 mm apart from each photosensitive drum in this embodiment). Thus, this arrangement is capable of preventing residual toner and the like on each photosensitive drum in a state not formed with a toner image from adhering to the intermediate transfer belt 11.

Figure 4C:
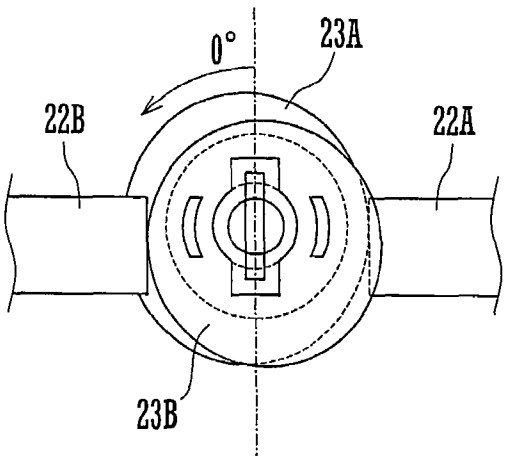
FIGS. 4A to 4C are schematic views each showing the structure of rotating cams included in the transfer device.
Figure 4A:
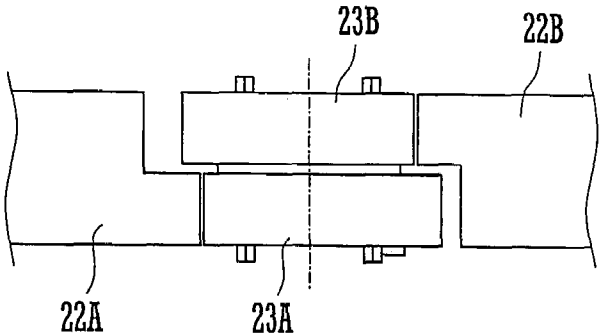
Figure 4B:
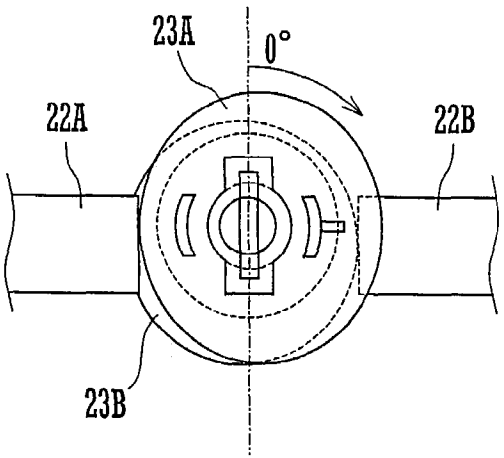

FIGS. 4A to 4C are schematic views showing the structure of the first and second rotating cams included in the transfer device in top plan, front elevation and rear elevation, respectively.

The first rotating cam 23A and the second rotating cam 23B have respective peripheral shapes and are rotatable together by a single driver not shown. The first rotating cam 23A causes the slide member 22A to reciprocate horizontally as the periphery of the rotating cam 23A displaces with rotation of the first rotating cam 23A. Similarly, the second rotating cam 23B causes the slide member 22B to reciprocate horizontally as the periphery of the rotating cam 23B displaces with rotation of the second rotating cam 23B. The peripheral shapes of the respective rotating cams 23A and 23B result in the cam diagrams at FIG. 5A and 5B, respectively. The cam diagrams of FIGS. 5A and 5B each plot horizontal displacement of the engagement position between each of the first and second rotating cams 23A and 23B and the associated one of the slide members 22A and 22B with increasing rotation angle relative to a cam base circle of 22.2 mm diameter, with the state shown in each of FIGS. 4B and 4C being established as an initial phase (0°).

FIGS. 6A to 6J are views illustrating transition of the state of the primary transfer rollers during one rotation of the rotating cams included in the transfer device embodying the present invention. FIGS. 6A to 6J, each of which are rear elevation of the transfer device 200, also illustrate switching between paths of movement of the intermediate transfer belt 11.

Figure 5A:
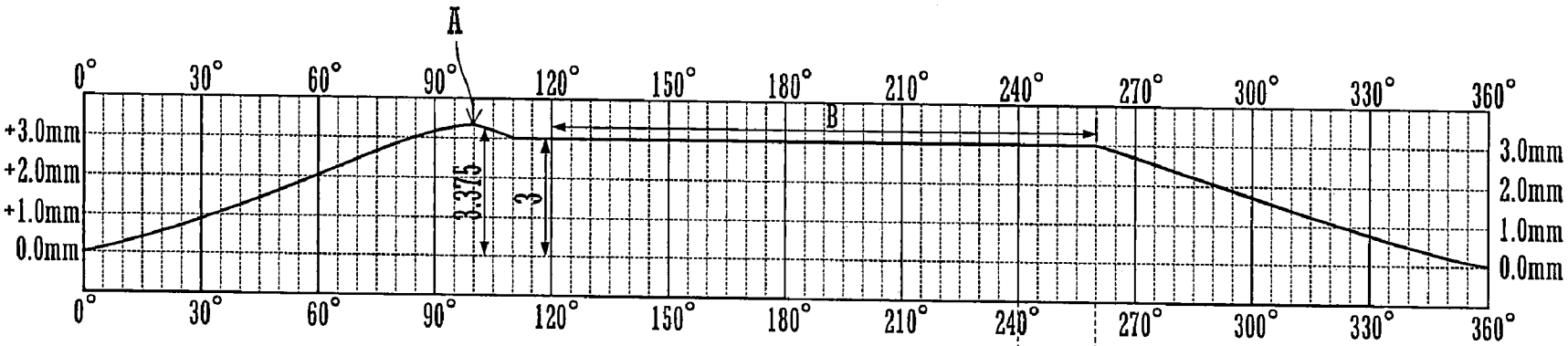
FIGS. 5A and 5B are cam diagrams of the rotating cams included in the transfer device.
Figure 5B:
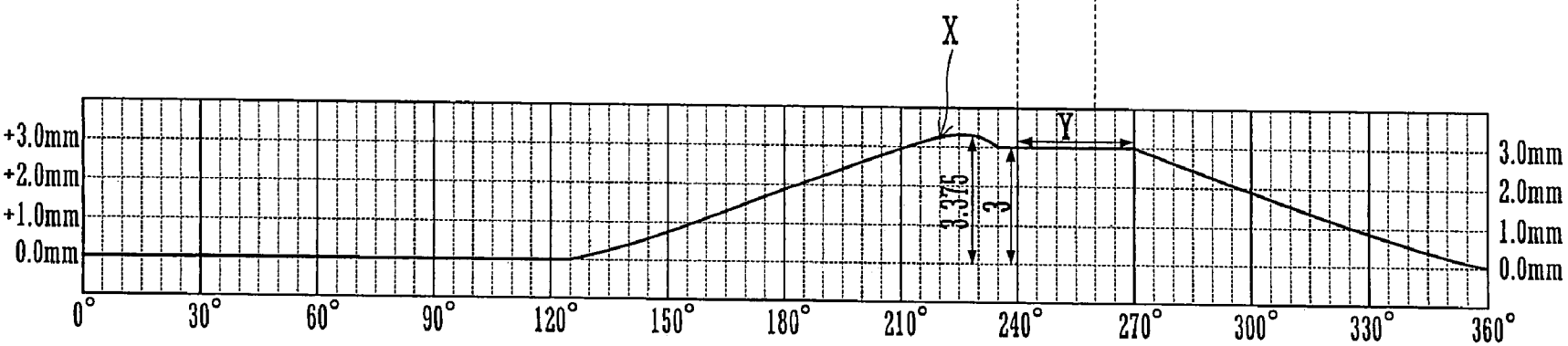

The state of the transfer device 200 where the rotating cams 23A and 23B are in their respective initial phases (0°) in FIGS. 5A and 5B is the standby state (initial state) where the primary transfer rollers 13A to 13D are kept apart from the photosensitive drums 101A to 101D and hence do not perform the primary transfer operation. The path of movement of the intermediate transfer belt 11 in the standby state corresponds to the third path defined by the present invention. In the state shown in FIG. 6B where an angle of cam rotation of 52.8755° is reached by rotation of the rotating cams 23A and 23*b* from the initial state, a monochromatic color sensor 30 is turned ON and the primary transfer roller 13A for monochromatic image formation assumes a position closer by a predetermined distance to the photosensitive drum 101A for monochromatic image formation. The monochromatic color sensor 30 detects the fact that the primary transfer roller 13A is approaching its low position at which the primary transfer roller 13A brings the intermediate transfer belt 11 into contact with the photosensitive drum 101A.

Figure 6A:
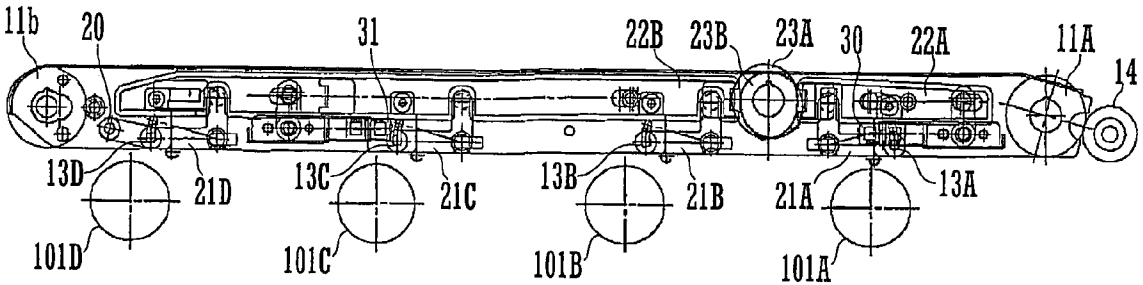
FIGS. 6A to 6J are views illustrating transition of the state of primary transfer rollers during one rotation of the rotating cams included in the transfer device.
Figure 6B:
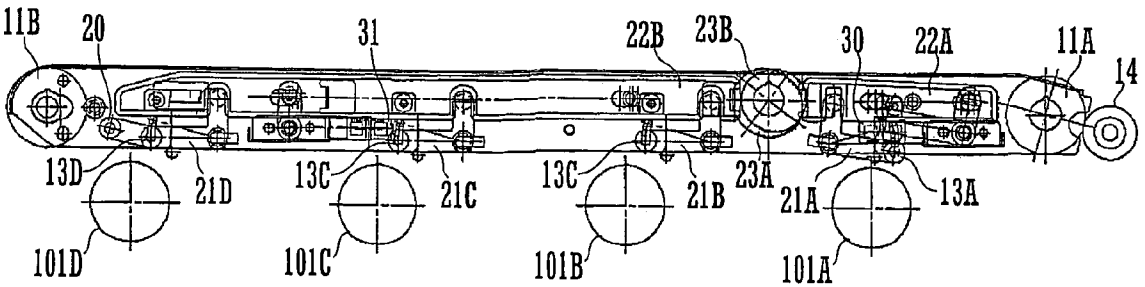
Figure 6C:
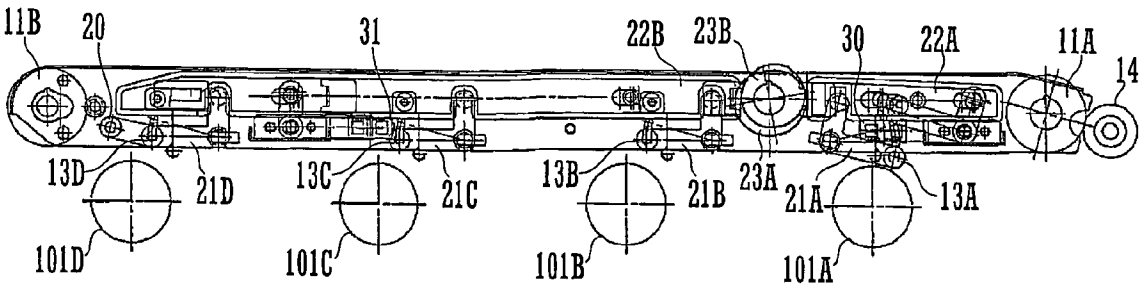

In the state shown in FIG. 6C where an angle of cam rotation of 100° is reached by further rotation of the rotating cams 23A and 23B, the first cam top dead center is reached. The first cam top dead center is a point most apart from the center of rotation and is indicated by point A in FIG. 5A. Since the slide member 22A slides horizontally to a position closest to the driving roller 11A at this time, the primary transfer roller 13A passes through its low position and reaches a position closest to the photosensitive drum 101A.

Figure 6D:
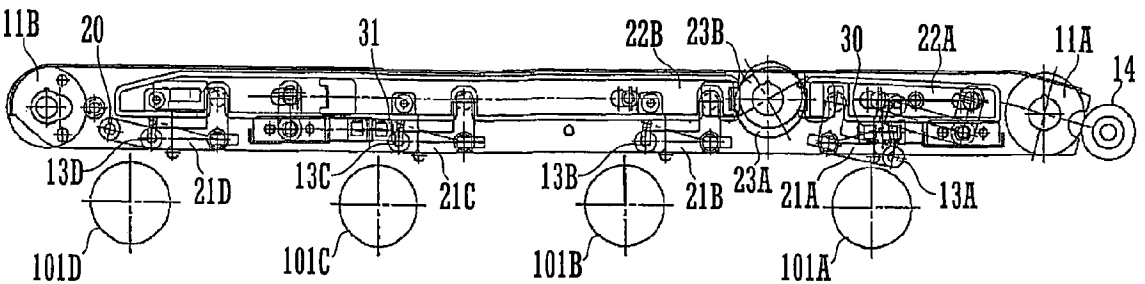

Subsequently, in the state shown in FIG. 6D at an angle of cam rotation of 120°, the primary transfer roller 13A is raised to its low position, so that the intermediate transfer belt 11 is brought into contact with the photosensitive drum 101A to assume a suitable state allowing the primary transfer of a black toner image formed on the photosensitive drum 101A to be effected. Within range B of angle of cam rotation from 120° to 260° the periphery of the primary transfer roller 13A displaces little and, hence, the intermediate transfer belt 11 can be kept in contact with the photosensitive drum 101A to allow the primary transfer to be effected. The path of movement of the intermediate transfer belt 11 formed in the monochromatic image formation corresponds to the second path defined by the present invention.

The purpose of the operation that primary transfer roller 13A is once lowered to the position lower than its low position and then raised to the low position as described above is to prevent the precision of transfer of a toner image from the photosensitive drum 101A to the intermediate transfer belt 11 from lowering due to switching of the path of movement of the intermediate transfer belt 11.

Since the primary transfer roller 13A in the position lower than its low position presses the intermediate transfer belt 11 against the photosensitive drum 101A more strongly than in the low position, the primary transfer roller 13A raised to the low position thereafter brings the intermediate transfer belt 11 into contact with the photosensitive drum 101A more conformably, thus enabling easier transfer to the intermediate transfer belt 11.

Figure 6E:
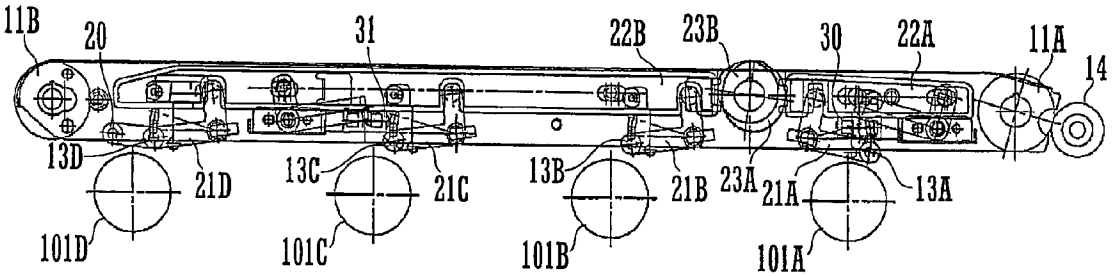
Figure 6F:
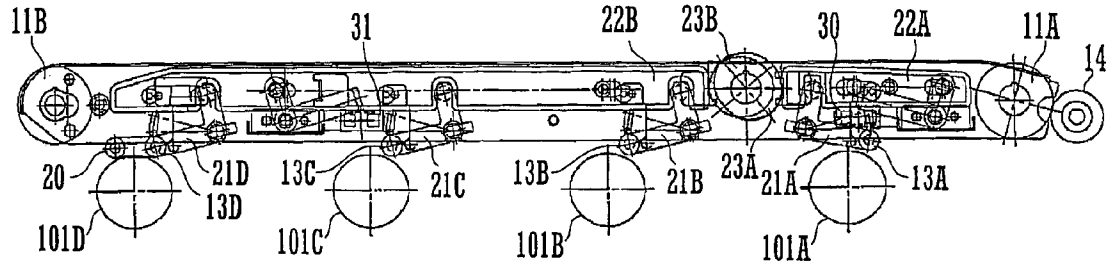

In the state shown in FIG. 6E at an angle of cam rotation of 172.8755°, a color sensor 31 is turned ON and the primary transfer rollers 13B to 13D for full-color image formation each assume a position closer by a predetermined distance to the associated one of the photosensitive drums 101B to 101D for full-color image formation. The color sensor 31 detects the fact that the primary transfer rollers 13B to 13D are approaching their low positions at which the primary transfer rollers 13B to 13D bring the intermediate transfer belt 11 into contact with the photosensitive drums 101B to 101D. In the state shown in FIG. 6F at an angle of cam rotation of 220°, the second cam top dead center is reached. The second cam top dead center is indicated by point X in FIG. 5B. Since the slide member 22B slides horizontally to a position closest to the driven roller 11B at this time, each of the primary transfer rollers 13B to 13D passes through its low positions and reaches a position closest to the associated one of the photosensitive drums 101B to 101D.

Figure 6G:
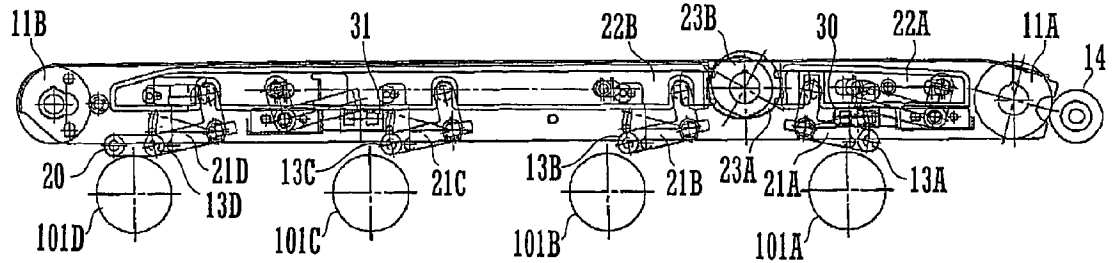

Subsequently, in the state shown in FIG. 6G at an angle of cam rotation of 240°, the primary transfer rollers 13B to 13D are raised to their low positions, so that the intermediate transfer belt 11 is brought into contact with the photosensitive drums 101B to 101D to assume a suitable state allowing the primary transfer of toner images of the respective colors formed on the respective photosensitive drums 101B to 101D to be effected. Within range Y of angle of cam rotation from 240° to 270° the periphery of each of the primary transfer rollers 13B to 13D displaces little and, hence, the intermediate transfer belt 11 can be kept in contact with the photosensitive drums 101B to 101D to allow the primary transfer to be effected. In the full-color image formation, the primary transfer of a black toner image from the photosensitive drum 101A to the intermediate transfer belt 11 is also effected and, therefore, the range C shown in FIG. 5A is a range allowing the primary transfer to be effected.

The path of movement of the intermediate transfer belt 11 formed in the full-color image formation corresponds to the first path defined by the present invention.

As the angle of cam rotation increases from about 260°, the horizontal engagement position between the first rotating cam 23A and the slide member 22A begins to move from the driving roller 11A toward the center of rotation of the first and second rotating cams 23A and 23B in the horizontal direction, causing the primary transfer roller 13A to begin rising. Further, as the angle of cam rotation increases from 260°, the horizontal engagement position between the second rotating cam 23B and the slide member 22B begins to move from the driven roller 11B toward the center of rotation of the first and second rotating cams 23A and 23B in the horizontal direction, causing the primary transfer rollers 13B to 13D to begin rising.

Figure 6H:
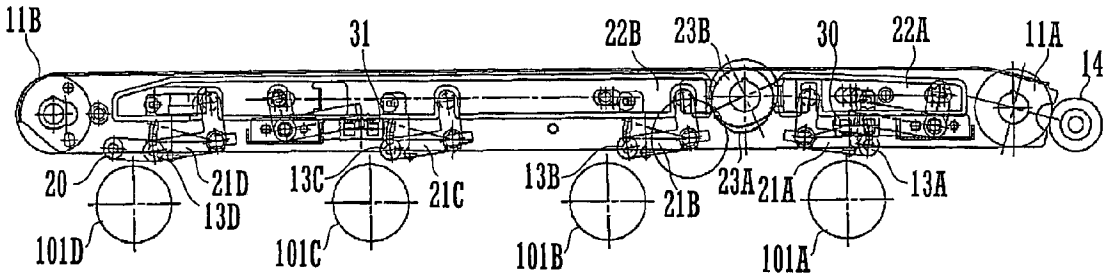
Figure 6I:
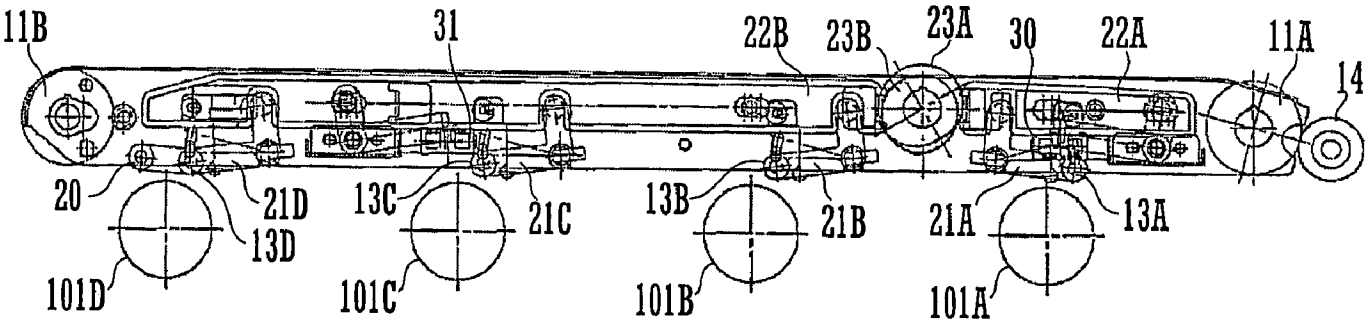
Figure 6J:
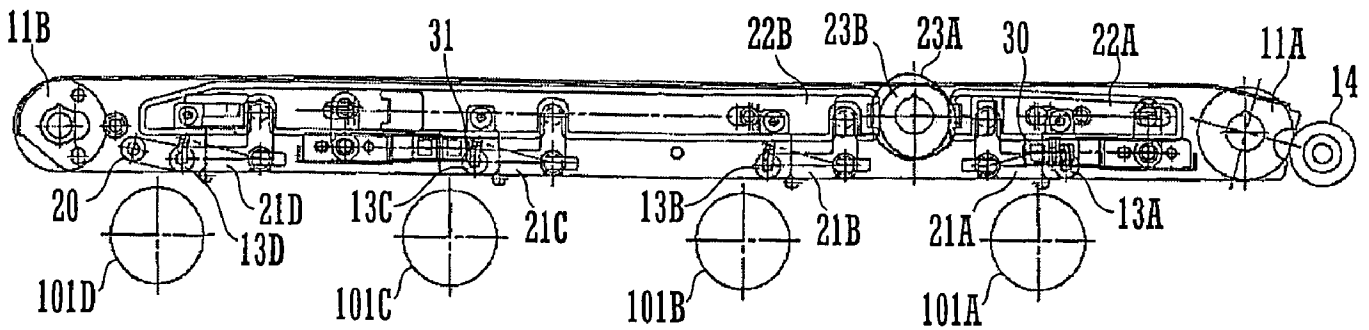

Thereafter, in the state shown in FIG. 6H at an angle of cam rotation of 294.2863°, the monochromatic color sensor 30 is turned OFF, and then in the state shown in FIG. 6I at an angle of cam rotation of 300.6704°, the color sensor 31 is turned OFF. Finally, in the state shown in FIG. 6J at an angle of cam rotation of 360°, the primary transfer rollers 13A to 13D resume the standby state where the rotating cams 23A and 23B are in their initial phases and the primary transfer rollers 13A to 13D are kept raised to their respective high positions.

As described above, by moving each of the primary transfer rollers 13A to 13D to any one of the positions suitable for respective of the full-color image formation, monochromatic image formation, and standby state, the path of movement of the lower side of the intermediate transfer belt 11 can be switched to any one of the three paths (first to third paths) selectively. In cooperation with this operation, a tension roller 25 supported at one end of a lever 26 engaging a spring at the other end as shown in FIG. 3 displaces up and down to keep the tension of the intermediate transfer belt 11 constant.

The roller lifting members 21A to 21D and the slide members 22A and 22B are included in the transfer member moving mechanisms defined by the present invention.

The first and second rotating cams 23A and 23B rotate in only one direction. The purpose of this feature is to suppress wear of the intermediate transfer belt 11. Since the first and second rotating cams 23A and 23B rotate to cause each of the primary transfer rollers 13A to 13D to lower to the position lower than its low position once and then rise to the low position, if the first and second rotating cams 23A and 23B are rotated in the reverse direction to raise each of the primary transfer rollers 13A to 13D from its low position, the intermediate transfer belt 11 is lowered to the position lower than the low position again and then raised and hence subjected to a downward force uselessly, which facilitates wear of the intermediate transfer belt 11 undesirably.

The primary transfer rollers 13B to 13D are shown as raised to such an extent as not contact the intermediate transfer belt 11 in the monochromatic image formation in FIGS. 6A to 6J. Actually, however, the primary transfer rollers 13B to 13D are positioned lower than illustrated by their own weights and hence are in contact with the intermediate transfer belt 11. Further, since the primary transfer bias attracts the intermediate transfer belt 11, the primary transfer rollers 13A to 13D are constantly in contact with the intermediate transfer belt 11.

In the transfer device 200 according to this embodiment, the roller lifting member 21D supports a pressure roller 20 together with the primary transfer roller 13D for rotation at the primary transfer position TD which is situated most upstream of the plural primary transfer positions TA to TD in the direction of movement of the intermediate transfer belt 11. The pressure roller 20 has an outside diameter equal to that of each primary transfer roller and is operative to press the intermediate transfer belt 11 so that the transfer nip width at the primary transfer position TD is equalized to the nip width at each of the other primary transfer positions TA to TC during the full-color image formation. The pressure roller 20 has an outer peripheral surface formed of an insulating material for example and, hence, the intermediate transfer belt 11 is not grounded via the pressure roller 20.

If the primary transfer bias applied to the intermediate transfer belt 11 via the primary transfer roller 13D is grounded via the pressure roller 20, a primary transfer electric field sufficient to transfer a toner image at the primary transfer position TD cannot be produced.

As described above, the transfer device 200 of the present invention including the roller lifting members 21A to 21D, slide members 22A and 22B, and the first and second coaxial rotating cams 23A and 23B is so constructed that the primary transfer rollers 13A to 13D move up and down as the peripheries of respective of the first and second rotating cams 23A and 23B displace with rotation. With this construction, a single driver is sufficient to drive the first and second coaxial rotating cams 23A and 23B. Further, since there is no need to provide rotating cams on separate axes for switching between the three paths of movement selectively, the arrangement for switching between the paths of movement can be simplified, which leads to a reduction in the size of the transfer device 200 and in cost.

Further, the transfer device 200 is configured to turn horizontal forces given to the slide members 22A and 22B, which work in directions parallel with the direction of movement of the intermediate transfer belt 11, into vertical forces for causing the primary transfer rollers 13A to 13D to move up and down by means of the roller lifting members 21A to 21D. With such a feature, a simple structure is sufficient to change the forces working to rotate the first and second rotating cams 23A and 23B into the forces working to raise and lower the primary transfer rollers 13A to 13B and, hence, switching between the paths of movement of the intermediate transfer belt 11 can be achieved easily. This feature also can contribute to a reduction in the size of the device and in cost.

The foregoing embodiment should be construed to be illustrative and not limitative of the present invention in all the points. The scope of the present invention is defined by the following claims, not by the foregoing embodiment. Further, it is intended that the scope of the present invention include the scopes of the claims and all the possible changes and modifications within the sense and scope of equivalents.

What is claimed is:

1. A transfer device comprising:

plural transfer rollers supported so as to be upwardly and downwardly movable within a looped path of movement defined by an endless belt and opposed to respective of plural image carriers across a portion of the endless belt, the plural image carriers including plural image carriers for full-color image formation and an image carrier for monochromatic image formation, which are arranged in a row from an upstream side to a downstream side in a fixed direction of movement of the endless belt;

a first path along which the endless belt is in contact with all the plural image carriers;

a second path along which the endless belt is in contact with only the image carrier for monochromatic image formation;

a third path along which the endless belt is spaced apart from all the plural image carriers;

a transfer member moving mechanism for full-color image formation operative to reciprocate in a direction substantially parallel with the fixed direction of movement to raise and lower the transfer rollers opposed to respective of the image carriers for full-color image formation;

a transfer member moving mechanism for monochromatic image formation operative to reciprocate in the direction substantially parallel with the fixed direction of movement to raise and lower the transfer roller opposed to the image carrier for monochromatic image formation; and first and second coaxial rotating cams having respective predetermined peripheral shapes, the first and second rotating cams being operative to cause respective of the transfer member moving mechanism for full-color image formation and the transfer member moving mechanism for monochromatic image formation to reciprocate as peripheries of respective of the first and second rotating cams displace with rotation, thereby switching the path of movement from one of the first to third paths to another selectively.

2. The transfer device according to claim 1, wherein:

the transfer member moving mechanism for monochromatic image formation comprises a slide member for monochromatic image formation which engages a portion of the periphery of the first rotating cam and is capable of reciprocation in the direction substantially parallel with the fixed direction of movement, and a roller lifting member for monochromatic image formation which is L-shaped in a section perpendicular to an axis of the transfer roller for monochromatic image formation and has one end supporting the transfer roller for monochromatic image formation for rotation, another end engaging the slide member for monochromatic image formation, and a bent portion pivotally supported on a shaft parallel with the axis of the transfer roller for monochromatic image formation; and the transfer member moving mechanism for full-color image formation comprises a slide member for full-color image formation which engages a portion of the periphery of the second rotating cam and is capable of reciprocation in the direction substantially parallel with the fixed direction of movement, and plural roller lifting members for full-color image formation, each of which is L-shaped in a section perpendicular to an axis of an associated one of the transfer rollers for full-color image formation and has one end supporting the associated one of the transfer rollers for full-color formation for rotation, another end engaging the slide member for full-color image formation, and a bent portion pivotally supported on a shaft parallel with the axis of the associated one of the transfer rollers for full-color image formation.

3. The transfer device according to claim 1, wherein the predetermined peripheral shapes are such that in lowering each of the plural transfer rollers to a low position at which the transfer roller brings the endless belt into contact with an associated one of the image carriers by reciprocations of respective of the transfer member moving mechanism for full-color image formation and the transfer member moving mechanism for monochromatic image formation, the transfer roller is caused to lower to a position lower than the low position once and then rise to the low position.

4. The transfer device according to claim 3, wherein the first and second rotating cams are rotatable in only one direction.

5. The transfer device according to claim 1, wherein the plural transfer rollers are constantly in contact with the endless belt.

6. The transfer device according to claim 1, wherein each of the plural transfer rollers is movable up to a high position from which transfer electric power fails to influence an associated one of the plural image carriers.

7. The transfer device according to claim 2, wherein:

the roller lifting member for monochromatic image formation has dimensions such that a distance from the end supporting the transfer roller for monochromatic image formation to the bent portion is longer than a distance from the end engaging the slide member for monochromatic image formation to the bent portion;

each of the roller lifting members for full-color image formation has dimensions such that a distance from the end supporting the associated one of the transfer rollers for full-color image formation to the bent portion is longer than a distance from the end engaging the slide member for full-color image formation to the bent portion.

* * * * *